US006172555B1

(12) United States Patent
Gusinov

(10) Patent No.: US 6,172,555 B1
(45) **Date of Patent: *Jan. 9, 2001**

(54) BANDGAP VOLTAGE REFERENCE CIRCUIT

(75) Inventor: Alex Gusinov, Lexington, MA (US)

(73) Assignee: Sipex Corporation

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/942,037

(22) Filed: Oct. 1, 1997

(51) Int. Cl.[7] ..... G05F 1/10

(52) U.S. Cl. ..... 327/539; 323/313

(58) Field of Search ..... 327/539, 538, 327/540, 512, 513, 530; 323/313, 312

(56) References Cited

U.S. PATENT DOCUMENTS

| | | | | |
|---|---|---|---|---|
| 3,617,859 | | 11/1971 | Dobkin et al. | 323/4 |
| 3,887,863 | | 6/1975 | Brokaw | 323/19 |
| 4,250,445 | | 2/1981 | Brokaw | 323/313 |
| 4,622,512 | | 11/1986 | Brokaw | 323/313 |
| 4,808,908 | | 2/1989 | Lewis et al. | 323/313 |
| 4,902,959 | | 2/1990 | Brokaw | 323/314 |
| 5,051,686 | * | 9/1991 | Schaffer | 323/313 |
| 5,081,410 | * | 1/1992 | Wood | 323/316 |
| 5,519,354 | * | 5/1996 | Audy | 327/512 |

OTHER PUBLICATIONS

Gray et al., *Analysis and Design of Analog Integrated Circuits,* 3rd Ed., John Wiley & Sons, Inc, NY, 1993 (pp. 338–346).

* cited by examiner

*Primary Examiner*—Jung Ho Kim
(74) *Attorney, Agent, or Firm*—Testa, Hurwitz & Thibeault, LLP

(57) ABSTRACT

A bandgap voltage reference circuit wherein a voltage change is induced across one element to compensate for the temperature-induced voltage change across another element. A stable voltage reference is realized across the series combination of the two elements. The circuit includes an operational amplifier, two transistors, a voltage divider and a non-linear temperature-dependent element. The operational amplifier has two input terminals and an output terminal. The voltage divider includes two resistor in series and is coupled to the operational amplifier output terminal. Each of the transistors has a collector corresponding to one of the operational amplifier input terminals, a base corresponding to one of the voltage divider resistor terminals, and an emitter coupled to a common voltage terminal. The non-linear temperature-dependent element is disposed between the voltage divider output terminal providing the lower voltage and the common voltage terminal. In one embodiment, the non-linear temperature-dependent element is a diode. In another embodiment, the non-linear temperature-dependent element is a bipolar junction transistor. The invention also relates to a method of providing a bandgap reference voltage.

5 Claims, 2 Drawing Sheets

BANDGAP VOLTAGE REFERENCE CIRCUIT

FIELD OF THE INVENTION

The invention relates generally to voltage reference circuits and more specifically to a bandgap voltage reference circuit that provides a stable voltage reference over a range of operating temperatures.

BACKGROUND OF THE INVENTION

Circuits that provide substantially stable reference voltages under varying conditions have existed for many years. One such circuit is the bandgap voltage reference circuit which is based on the base to emitter voltage ($V_{BE}$) of bipolar junction transistors. The circuit typically utilizes two transistors operating at different current densities. A voltage proportional to the difference between the base to emitter voltages ($\Delta V_{BE}$) of the two transistors is developed within the circuit. Typically, the $\Delta V_{BE}$ voltage developed by the circuit increases with increasing temperature and the $V_{BE}$ voltage of the transistor decreases with increasing temperature such that the sum of the two voltages can be arranged to be substantially independent of temperature.

FIG. 1 illustrates a voltage reference circuit 10 known to the prior art described in P. R. Gray and R. G. Meyer, *Analysis and Design of Analog Integrated Circuits*, John Wiley & Sons, New York, N.Y., 1993, at 344–346. In order for a stable operating point to exist, the differential input voltage defined across input terminals 18 and 22 of the operational amplifier 26 must be zero. Thus, the voltage drop across R1 30 must equal the voltage drop across R2 34. Assuming negligible base currents for transistors Q1 38 and Q2 42, a $\Delta V_{BE}$ must exist across resistor R3 46. As the temperature increases, $V_{BE}$ of Q2 42 decreases. The two currents $I_1$ 32 and $I_2$ 36 must have a ratio determined by the ratio of R1 30 to R2 34. These two currents are the collector currents of the two diode-connected transistors Q1 38 and Q2 42, assuming base currents are negligible. Thus the difference between their base to emitter voltages is $$\Delta V_{BE} = V_T \ln \frac{I_1 I_{S2}}{I_2 I_{S1}} = V_T \ln \frac{R2 I_{S2}}{R1 I_{S1}}$$

where $I_{S1}$ and $I_{S2}$ are the device dependent saturation currents of Q1 38 and Q2 42, respectively. $V_T$ is given by $$V_T = \frac{kT}{q}$$

where k is Boltzmann's constant, T is the absolute temperature in Kelvin, and q is the charge of an electron. $\Delta V_{BE}$ appears across resistor R3 46 and is proportional to absolute temperature. The same current that flows in R3 46 also flows in R2 34, so that the voltage across R2 34 must be $$V_{R2} = \frac{R2}{R3} \Delta V_{BE} = \frac{R2}{R3} V_T \ln \frac{R2 I_{S2}}{R1 I_{S1}}$$

The output voltage $V_{OUT}$ 14 is the sum of the voltage across R1 30 and the voltage across Q1 38. The voltage across R1 30 is equal to that across R2 34 indicated above. The output voltage is thus $$V_{OUT} = V_{BE1} + \frac{R2}{R3} V_T \ln \frac{R2 I_{S2}}{R1 I_{S1}}$$

where $V_{BE1}$ is the base to emitter voltage of Q1 38.

The resulting $V_{OUT}$ can be arranged to have an effective temperature coefficient of zero. To achieve this result, the parameters of transistors Q1 38 and Q2 42, and resistors R1 30, R2 34 and R3 46 must be strictly controlled.

FIG. 2 illustrates another prior art voltage reference circuit 50 as disclosed in U.S. Pat. No. 3,887,863. In this circuit, the input signals 54 and 58 to the operational amplifier 62 are proportional to the voltage drops across load resistors R1 64 and R2 68. If the voltage drops are not equal, the operational amplifier output drives the base of transistors Q1 72 and Q2 76 so as to establish equal currents through R1 64 and R2 68. In this example, $\Delta V_{BE}$ is proportional to the voltage measured across resistor R3 80. As the temperature changes the change in $\Delta V_{BE}$ is compensated by the change in voltage across R3 80 such that the voltage drop across the series combination of Q2 76 and R3 80 is equal to the voltage drop across Q1 72. The resulting output voltage ($V_{OUT}$) 84 can be arranged to provide a temperature independent voltage reference. Again, proper functioning of this bandgap voltage reference circuit requires critical matching of R1 64, R2 68, R3 80, R4 88, Q1 72 and Q2 76.

These prior art references are representative of efforts to improve the stability of bandgap voltage reference sources at the expense of circuit complexity and an increase in the stringency of the component matching requirements. The present invention provides a bandgap voltage reference circuit capable of operation with a low supply voltage. The circuit has a low device count and reduced component matching requirements without loss of performance.

SUMMARY OF THE INVENTION

The bandgap voltage reference circuit of the invention in one embodiment includes an operational amplifier, a first and second transistor, a voltage divider and a non-linear temperature-dependent element. The operational amplifier includes a pair of input terminals and an output terminal. The operational amplifier is sensitive to the difference in the current through its input terminals. Each operational amplifier input terminal is in electrical communication with a corresponding transistor collector. Each transistor emitter is adapted to receive an input reference voltage. The areas of the transistor emitters are unequal. In one embodiment, the applied input reference voltage is ground.

In one embodiment, the voltage divider includes a first resistor having a first terminal in electrical communication with the output terminal of the operational amplifier and a second terminal in electrical communication with the base of the first transistor. The voltage divider also includes a second resistor having a first terminal in electrical communication with the second terminal of the first resistor and a second terminal in electrical communication with the base of the second transistor. In one embodiment, the non-linear temperature-dependent device has one terminal electrically coupled to the second terminal of the second resistor and a second terminal adapted to receive a second input reference voltage. In one embodiment, the ratio of the resistance of the first and second resistors is given by the equation $$\frac{R1}{R2} = \frac{V_{OUT} - V_{BE}}{\Delta V_{BE}}$$

where $V_{OUT}$ is the reference voltage provided by the circuit, $V_E$ is the voltage drop across the first terminal of the non-inear temperature-dependent element and the second terminal of the non-linear temperature-dependent element, and $\Delta V_{BE}$ is the differential voltage between the base of the first transistor and the base of the second transistor, where the base currents of the transistors are negligible. In another embodiment, the ratio of the resistance of the first and second resistors is given by the equation $$\frac{R1}{R2} = \frac{V_{OUT} - V_E}{\Delta V_{BE}}$$

In one embodiment, the non-linear temperature-dependent element is a diode. In another embodiment, the non-linear temperature-dependent element is a bipolar junction transistor having a base electrically coupled to the second terminal of the first resistor, an emitter adapted to receive the second input reference voltage, and a collector electrically coupled to the second terminal of the second resistor. In another embodiment, the bipolar junction transistor has a base electrically coupled to its collector instead of the second terminal of the first resistor.

The invention also relates to a method for providing a bandgap voltage reference. The method includes providing a voltage reference subcircuit comprising a reference voltage input terminal, an operational amplifier, and a first and second transistor. The operational amplifier includes a first and second input terminal and an output terminal. Each transistor includes a collector in electrical communication with a corresponding operational amplifier input and an emitter in electrical communication with the reference voltage input terminal. The method includes the steps of applying an input reference voltage to the reference voltage input terminal and generating an output voltage at the output of the operational amplifier. The operational amplifier output voltage is modified and applied at different voltage levels to the bases of the two transistors. In one embodiment, the output voltage of the operational amplifier is applied to a voltage divider in electrical communication with the base of each transistor. The method also includes the step of providing a non-linear temperature-dependent voltage drop between the base of the second transistor and the reference voltage input terminal.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

Like reference characters in the respective drawn figures indicate corresponding parts.

DETAILED DESCRIPTION OF THE INVENTION

Figure 1:
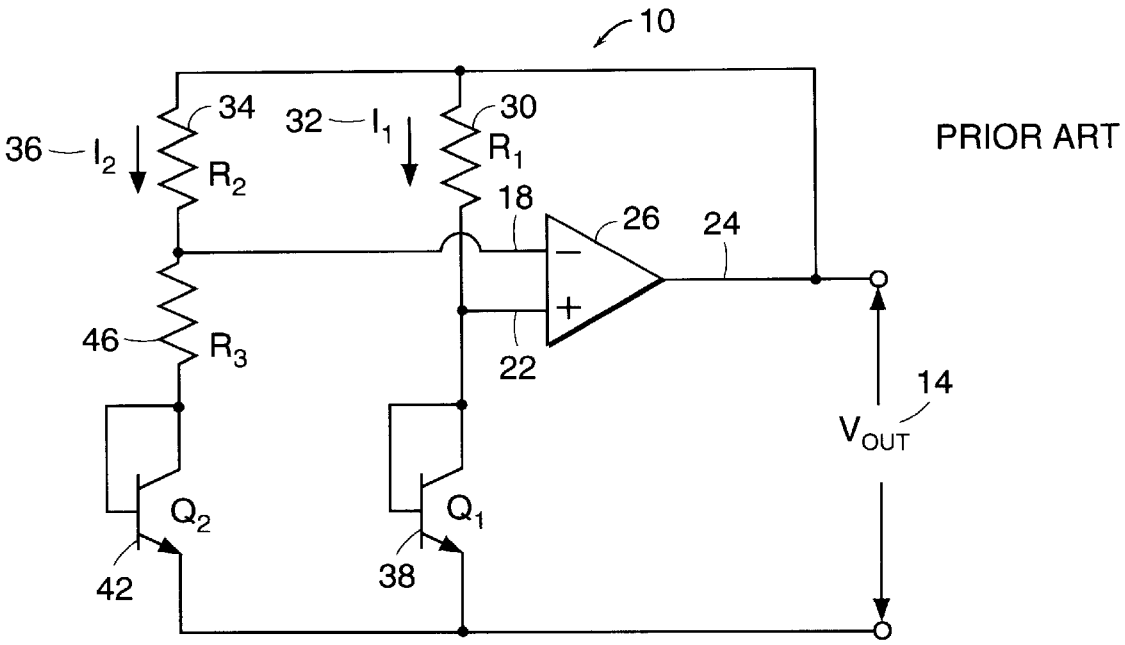
FIG. 1 is a schematic diagram of a bandgap voltage reference circuit known to the prior art.
Figure 2:
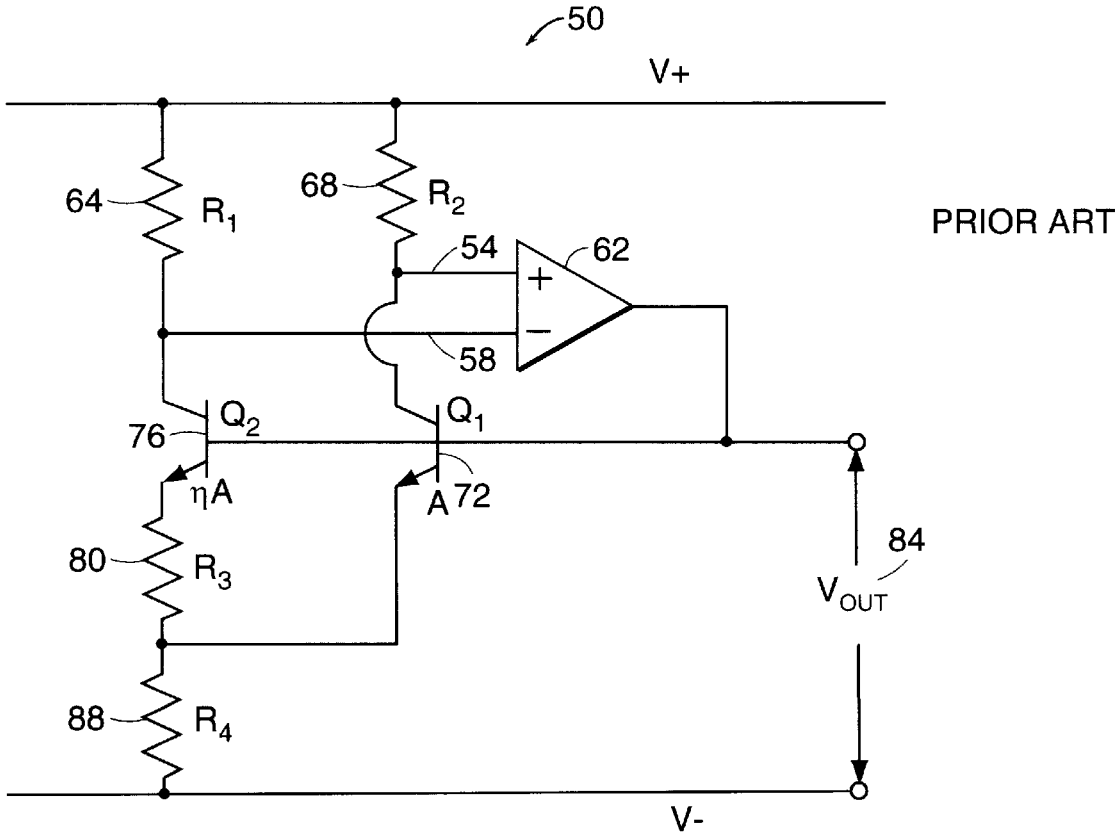
FIG. 2 is a schematic diagram of another bandgap voltage reference circuit known to the prior art.
Figure 3:
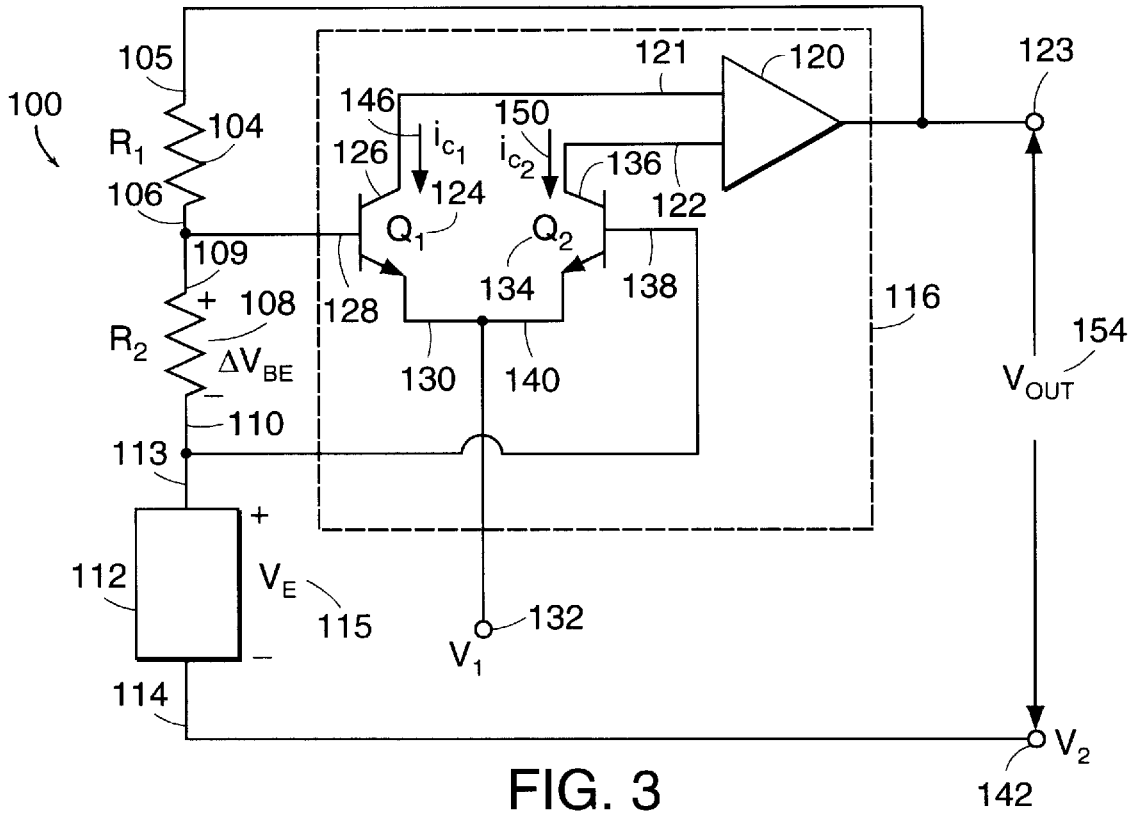
FIG. 3 is a schematic diagram of an embodiment of a bandgap voltage reference circuit built in accordance with the present invention.

Referring to FIG. 3, a bandgap voltage reference circuit 100 in accordance with the present invention is shown. The operation of the circuit 100 is based on a negative feedback circuit to provide a summation of two voltage components; one voltage having a positive temperature coefficient and the second voltage having a negative temperature coefficient, which results in an output voltage which is nearly independent of temperature.

The circuit 100 includes first and second resistors 104 and 108, a non-linear temperature-dependent element 112, and a subcircuit 116. In one embodiment, the non-linear temperature-dependent element 112 is a diode. The subcircuit 116 includes an operational amplifier 120, first and second transistors, 124 and 134 respectively, and a first input reference voltage terminal 132. In one embodiment, the first and second transistors, 124 and 134 respectively, are integrated into the operational amplifier circuit 120. The collector 126 of the first transistor 124 is connected to the first input 121 of the operational amplifier 120. The collector 136 of the second transistor 134 is connected to the second input 122 of the operational amplifier 120. The emitters 130 and 140 of the two transistors 124 and 134, respectively, are connected to the first input reference voltage terminal 132.

The first terminal 105 of the first resistor 104 is connected to the output 123 of the operational amplifier 120. The second terminal 110 of the second resistor 108 is connected to the first terminal 113 of the non-linear temperature-dependent element 112. The second terminal 106 of first resistor 104 is connected to the first terminal 109 of the second resistor 108 to form a voltage divider. A second terminal 114 of the non-linear temperature-dependent element 112 is connected to a second input reference voltage terminal 142. The base 128 of the first transistor 124 is connected to the second terminal 106 of the first resistor 104. The base 138 of the second transistor 134 is connected to the second terminal 110 of the second resistor 108.

The operational amplifier 120 is sensitive to the difference in the current through its inputs 121 and 122. The output 123 of the operational amplifier 120 reaches equilibrium when the collector currents $i_{c1}$ 146 and $i_{c2}$ 150 of transistors Q1 124 and Q2 134, respectively, are equal. Transistors Q1 124 and Q2 134 are mismatched such that the emitter area of Q2 134 is n times the emitter area of Q1 124, where n is greater than one. By using mismatched transistors 124 and 134, collector currents $i_{c1}$ 146 and $i_{c2}$ 150 are equal when $\Delta V_{BE}$, the differential voltage between the base 128 of the first transistor 124 and the base 138 of the second transistor 134, is given by:

$$\Delta V_{BE} = \frac{kT}{q}\ln(n)$$

where k is Boltzmann's constant, T is the absolute temperature in Kelvin, and q is the charge of an electron. The above relationship is satisfied when resistors R1 104 and R2 108 are related such that:

$$V_{OUT} = V_E + \Delta V_{BE}\left(1 + \frac{R1}{R2}\right)$$

where $V_{OUT}$ 154 is the output voltage reference, $V_E$ 115 is the voltage drop across the terminals 113 and 114 of the non-inear temperature-dependent element 112, and negligible base currents have been assumed for each transistor 124 and 134.

As the temperature changes, the voltage ($V_E$) 115 across the non-linear temperature dependent element 112 also changes. To maintain equilibrium at the output voltage reference ($V_{OUT}$) 154 between the output voltage reference terminals 123 and 142, the operational amplifier 120 increases or decreases the current through R1 104 and R2 108. This causes $\Delta V_{BE}$ to change according to the above relationship so that collector currents $i_{c1}$ 146 and $i_{c2}$ 150 are held equal. The result is a modified voltage drop across R1 104 and R2 108 that compensates for the changed voltage drop $V_E$ 115 across the non-linear temperature-dependent element 112.

Figure 4:
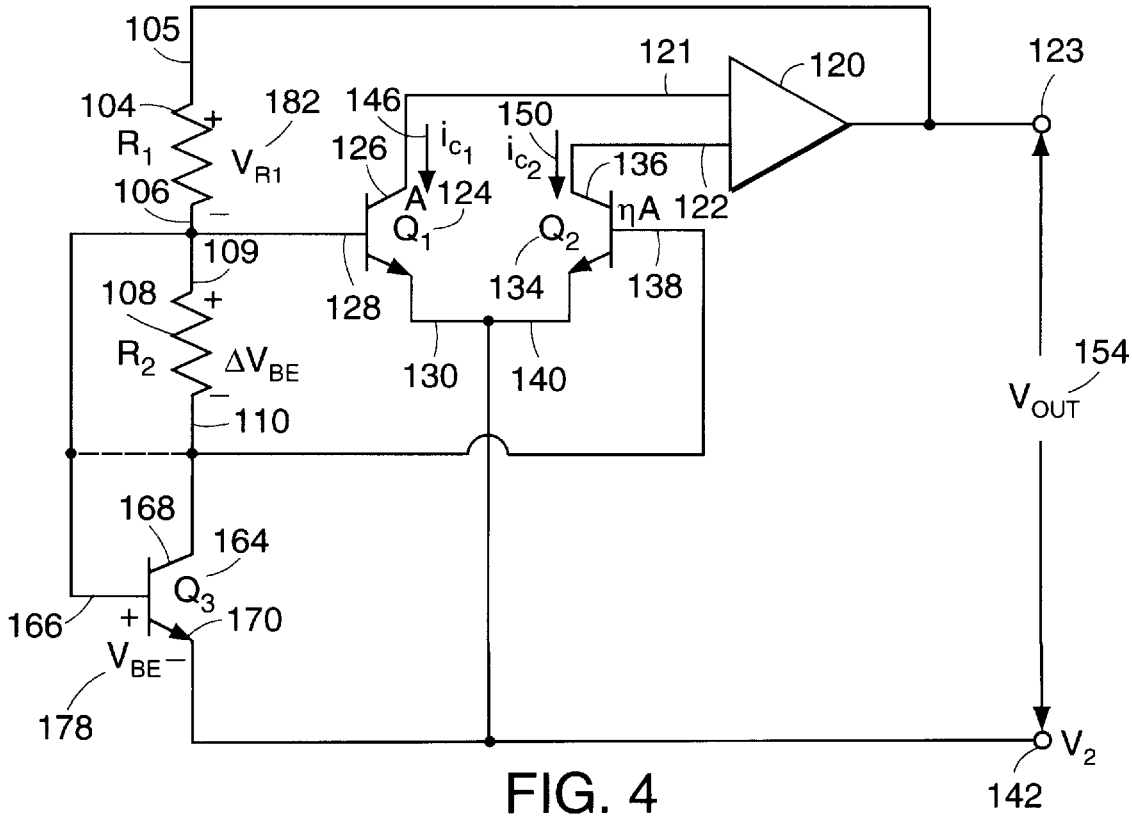
FIG. 4 is a schematic diagram of the bandgap voltage reference circuit of FIG. 3 employing a bipolar junction transistor as the non-linear temperature-dependent element and having common input reference voltages.

The circuit 160 of FIG. 4 shows the preferred embodiment of the present invention employing a bipolarjunction transistor 164 as the non-linear temperature-dependent element. The base 166, collector 168, and emitter 170 of the bipolar junction transistor 164 are connected to the base 128 of the first transistor 124, the base 138 of the second transistor 134, and the input voltage reference terminal 142, respectively. In another embodiment, the base 166 of the bipolar junction transistor 134 is connected to a variable resistance (not shown) substituted for R1 104 or R2 108 to achieve other operating conditions. In yet another embodiment, the bipolar junction transistor 164 is configured as a diode in which its base 166 is connected to its collector 168, rather than the base 128 of the first transistor 124, as shown in phantom in FIG. 4. The emitters 130 and 140 of the first and second transistors 124 and 134 are also connected to the input voltage reference terminal 142. Again, the ratio of the emitter area of the second transistor 134 is n times greater than the emitter area of the first transistor 124, where n is greater than one. Assuming negligible base currents for Q1 124, Q2 134, and Q3 164, the output reference voltage $V_{OUT}$ is given by:

$$V_{OUT} = V_{BE} + \Delta V_{BE}\left(\frac{R1}{R2}\right)$$

The output reference voltage ($V_{OUT}$) 154 presented across terminals 123 and 142 is equal to the sum of the base to emitter voltage $V_{BE}$ 178 of the bipolar junction transistor 164 and the voltage $V_{R1}$ 182 across the first resistor 104. As the temperature increases, $V_{BE}$ 178 decreases. Thus the current through R1 104 must increase such that $V_{R1}$ 182 increases so that $V_{OUT}$ 154 remains constant. The increased current flowing through R1 104 also flows through R2 108 resulting in an increase in $\Delta V_{BE}$. This corresponds to equal collector currents $i_{c1}$ 146 and $i_{c2}$ 150 and the operational amplifier 120 remains in equilibrium. This same negative feedback inherent in the circuit reacts to a decrease in temperature in similar fashion to maintain $V_{OUT}$ 154 at the desired level.

Thus the bandgap voltage reference circuit of the present invention has advantageous characteristics, including a nearly zero variation in the output voltage reference over a range of operating temperatures. Other advantages include a low device count and reduced component matching requirements. The present invention is particularly useful for low voltage operation, since transistors Q1 124 and Q2 134 have emitters 130 and 140, respectively, are grounded. As a result, the full supply voltage is available between the collectors 126 and 136 and emitters 130 and 140, respectively. This allows cascading and other techniques even when low supply voltage operation is required.

Having described preferred embodiments of the invention, it will now become apparent to one of skill in the art that other embodiments incorporating the concepts may be used. It is felt, therefore, that these embodiments should not be limited to disclosed embodiments but rather should be limited only by the spirit and scope of the following claims.

What is claimed is:

1. A voltage reference circuit for generating a reference voltage, comprising:

an operational amplifier having a first input terminal, a second input terminal and an output terminal for providing said reference voltage;

a first transistor having a collector directly connected to said first input terminal of said operational amplifier, an emitter directly connected to a first input reference terminal, and a base;

a second transistor having a collector directly connected to said second input terminal of said operational amplifier, an emitter directly connected to said emitter of said first transistor, and a base;

a voltage divider comprising a first resistor and a second resistor, said first resistor having a first terminal directly connected to said output terminal of said operational amplifier and a second terminal directly connected to said base of said first transistor, said second resistor having a first terminal directly connected to said second terminal of said first resistor and a second terminal directly connected to said base of said second transistor; and a diode having a first terminal directly connected to said second terminal of said second resistor, and a second terminal directly connected to a second input reference terminal.

2. A voltage reference circuit for generating a reference voltage, comprising:

an operational amplifier having a first input terminal, a second input terminal and an output terminal for providing said reference voltage;

a first transistor having a collector directly connected to said first input terminal of said operational amplifier, an emitter directly connected to a first input reference terminal, and a base;

a second transistor having a collector directly connected to said second input terminal of said operational amplifier, an emitter directly connected to said emitter of said first transistor, and a base;

a voltage divider comprising a first resistor and a second resistor, said first resistor having a first terminal directly connected to said output terminal of said operational amplifier and a second terminal directly connected to said base of said first transistor, said second resistor having a first terminal directly connected to said second terminal of said first resistor and a second terminal directly connected to said base of said second transistor; and a bipolar junction transistor having a base directly connected to said second terminal of said second resistor, an emitter directly connected to said second input reference terminal and a collector directly connected to said second terminal of said second resistor, wherein the ratio of the resistance of said first resistor R1 to the resistance of said second resistor R2 is given by the equation $$\frac{R1}{R2} = \frac{V_{OUT} - V_{BE}}{\Delta V_{BE}}$$

where $V_{OUT}$ is said reference voltage generated by said circuit, $V_{BE}$ is the base to emitter voltage drop of said bipolar junction transistor, and $\Delta V_{BE}$ is the differential voltage between said base of said first transistor and said base of said second transistor.

3. A voltage reference circuit for generating a reference voltage, comprising:

a ground terminal;

an operational amplifier having a first input terminal, a second input terminal and an output terminal for providing said reference voltage;

a first transistor having a collector directly connected to said first input of said operational amplifier, an emitter directly connected to said ground terminal, and a base;

a second transistor having a collector directly connected to said second input terminal of said operational amplifier, an emitter directly connected to said ground terminal, and a base, wherein an area of said emitter of said second transistor is greater than an area of said emitter of said first transistor;

a voltage divider comprising a first resistor and a second resistor, said first resistor having a first terminal directly connected to said output terminal of said operational amplifier and a second terminal directly connected to said base of said first transistor, said second resistor having a first terminal directly connected to said second terminal of said first resistor and a second terminal directly connected to said base terminal of said second transistor; and a bipolar junction transistor having a base directly connected to said second terminal of said first resistor, an emitter directly connected to said ground terminal, and a collector directly connected to said second terminal of said second resistor.

4. A voltage reference circuit for generating a reference voltage, comprising:

an operational amplifier having a first input terminal, a second input terminal and an output terminal for providing said reference voltage;

a first transistor having a collector in electrical communication said first input terminal of said operational amplifier, an emitter electrically coupled to a first input reference terminal, and a base;

a second transistor having a collector in electrical communication with said second input terminal of said operational amplifier, an emitter electrically coupled to said emitter of said first transistor, and a base;

a voltage divider comprising a first resistor and a second resistor, said first resistor having a first terminal in electrical communication with said output terminal of said operational amplifier and a second terminal in electrical communication with said base of said first transistor, said second resistor having a first terminal in electrical communication with said second terminal of said first resistor and a second terminal in electrical communication with said base of said second transistor; and a bipolar junction transistor having a base in electrical communication with said second terminal of said first resistor, an emitter adapted to receive the second input reference voltage, and a collector in electrical communication with said second terminal of said second resistor, wherein the ratio of the resistance of said first resistor R1 to the resistance of said second resistor R2 is given by the equation $$\frac{R1}{R2} = \frac{V_{OUT} - V_{BE}}{\Delta V_{BE}}$$

where $V_{OUT}$ is said reference voltage generated by said circuit, $V_{BE}$ is the base to emitter voltage drop of said bipolar junction transistor, and $\Delta V_{BE}$ is the differential voltage between said base of said first transistor and said base of said second transistor.

5. A voltage reference circuit for generating a reference voltage, comprising:

an operational amplifier having a first input terminal, a second input terminal and an output terminal for providing said reference voltage;

a first transistor having a collector in electrical communication said first input terminal of said operational amplifier, an emitter electrically coupled to a first input reference terminal, and a base;

a second transistor having a collector in electrical communication with said second input terminal of said operational amplifier, an emitter electrically coupled to said emitter of said first transistor, and a base;

a voltage divider comprising a first resistor and a second resistor, said first resistor having a first terminal in electrical communication with said output terminal of said operational amplifier and a second terminal in electrical communication with said base of said first transistor, said second resistor having a first terminal in electrical communication with said second terminal of said first resistor and a second terminal in electrical communication with said base of said second transistor; and a diode having a first terminal in electrical communication with said second terminal of said second resistor and a second terminal electrically coupled to a second input reference terminal, wherein the ratio of the resistance of said first resistor R1 to the resistance of said second resistor R2 is given by the equation $$\frac{R1}{R2} = \left(\frac{V_{OUT} - V_E}{\Delta V_{BE}}\right) - 1$$

where $V_{OUT}$ is said reference voltage generated by said circuit, $V_E$ is the voltage drop between said first terminal of said non-linear temperature-dependent element and said second terminal of said non-linear temperature-dependent element, and $\Delta V_{BE}$ is the differential voltage between said base of said first transistor and said base of said second transistor.

* * * * *